United States Patent [19]

Meckler

[11] 3,996,759

[45] Dec. 14, 1976

[54] ENVIRONMENT ASSISTED HYDRONIC HEAT PUMP SYSTEM

[76] Inventor: Milton Meckler, 16348 Tupper St., Sepulveda, Calif. 91343

[22] Filed: Nov. 3, 1975

[21] Appl. No.: 627,851

[52] U.S. Cl. ..... 62/2; 62/238; 165/18; 165/62; 126/400; 237/1 A

[51] Int. Cl.[2] ..... F25B 27/00

[58] Field of Search ..... 126/400; 237/1 A, 2 B; 62/2, 238; 165/18, 62

[56] References Cited

UNITED STATES PATENTS

| | | | |
|---|---|---|---|
| 2,389,440 | 11/1945 | Kucher | 165/62 X |
| 2,529,154 | 11/1950 | Hammond et al. | 62/2 X |
| 2,680,565 | 6/1954 | Lof | 62/2 X |
| 2,794,332 | 6/1957 | Boss | 165/62 X |
| 2,933,885 | 4/1960 | Benedek et al. | 237/1 A X |
| 3,262,493 | 7/1966 | Hervey | 165/18 X |

*Primary Examiner*—William E. Wayner
*Assistant Examiner*—William E. Tapolcai, Jr.

[57] ABSTRACT

An air conditioning system utilizing one or more water source heat pumps assisted by solar radiation, terrestrial re-radiation and ambient air above predetermined temperature levels; operating primarily in cooperation with a stratified thermal mass in the form of a hot liquid storage tank that is compartmented according to the operational temperatures of high range closed circuit solar energy accumulation, moderate range closed circuit heat pump requirements and low range auxiliary needs, the collection of solar heat being applied to all ranges whereby temperature differential is maximized for solar collection; and operating secondarily in cooperation with a thermal mass in the form of a cold liquid storage tank charged through a cooler means and/or assisted by terrestrial re-radiation and used to provide supplementary cooling capacity for the heat pump when required, whereby the operational water temperature range of the heat pump is maintained for effective functioning of the system.

23 Claims, 3 Drawing Figures

RE RADIATION
SOLAR
B
G
51
58
57
I'
54
50
26
44
E
42
65
40
38
43
37
12'
11'
52
45
F
39
41
22
66
10
18
17
19
23
20
71
I
21
T
A
C
55
56
70
24
15
36
H
12
11
16
60
14
16'
D
33
13
33
35
30
27
25
X
Z
Y
32
a
b
c
34
100
34

ENVIRONMENT ASSISTED HYDRONIC HEAT PUMP SYSTEM

BACKGROUND

Air conditioning systems require energy for raising and lowering air temperature and which can be assisted by the storage of "solar insolation" heated liquid and/or conversely by the storage of "terrestrial re-radiation" cooled liquid, and also assisted by absorption from or into the surrounding ambient air. The utilization of said forms of energy storage has been practiced independently and aggregatively, but not cooperatively as will be disclosed herein and combined in a system characterized by a stratified thermal mass that separates the several heat transferring circuits that must operate within different temperature ranges, respectively.

The prior art operation of water source heat pumps has been restrictive in various respects. For instance, diversity which permits a reduction in building co-incident load demands has been available only on the heating cycle, while on the cooling cycle there has been no such diversity capability since with the mechanical refrigeration equipment physically in each pre-selected temperature control zone there is no conventional means to re-distribute the excess cooling capacity of any unit at any given time to other heat pump units similarily operating on a cooling cycle. On the contrary, the present invention provides diversity on cooling, as well as on heating, through the introduction of cold thermal storage applied as hereinafter described. Further, the prior art systems of the type under consideration have not minimized thermal differential, or Delta-T, in the cooperative relationship of solar collectors and thermal mass heat storage, as it is accomplished by means of the stratified mass hereinafter disclosed and tapped at optimum temperature ranges as related to purpose. Still further, the prior art has not taken full advantage of the availability of temperature differences at separated zones being air conditioned, whereas the present invention provides each heat pump with either hot mass or cold mass assistance, thereby reducing unit capacity requirements and providing for full peak operation of independent units, as circumstances require.

The collection of solar heat energy is normally within a range of nominally 100° to 180° F or higher, while the heat pump is properly operative from a water source within a range of 55° to 90° F; and these high and moderate ranges require commensurately proportioned thermal masses for effective utilization of stored heat energy. To these ends I have provided a stratified thermal mass in the form of a compartmented liquid storage tank wherein the solar heat is stored at high temperatures, wherein the heat pump water source withdraws heat at moderate temperatures, and wherein residual heat at low temperatures is utilized for auxiliary purposes such as to preheat a domestic hot water supply. It is an object, therefore, to cooperatively relate and combine the solar energy assistance with the operational requirements of a water source heat pump and to utilize residual heat to the fullest extent. Additionally, it is an object to maintain a cold liquid storage which becomes necessary, at times, to provide supplementary cooling capacity for the heat pump when in the cooling mode, and to this end I have provided cooling means, both by mechanical and by terrestrial re-radiation, and cooperatively associated with the heat pump to be used directly in the cooling of recirculated useful air for which the system is designed to condition.

It is assistance for one or more liquid or water source heat pumps with which the present invention is concerned, a comprehensive concept which involves the conservation of energy, both by collection of available solar insolation and by use of terrestrial re-radiation, and assisted by heat absorption to or from and from within the system under extreme conditions. It is to be observed, particularly, that the more or less predictable collection of solar energy in a thermal mass is variable to say the least, however beneficial that heat may be. It is also to be observed, particularly, that water source heat pumps have a practical operating range, at times below the temperature of said thermal mass storage of solar energy and at times above said thermal mass temperature, at whatever temperature variant said mass might be above or below the range of normal heat pump operation. That is, there will be times when the remaining solar energy stored in the thermal mass is less than said 55 ° F minimum, and times when more than said 90° F maximum. To this end, therefore, the thermal mass is stratified in accordance with the present invention in a compartmented storage tank employing thermal convection for circulation of a liquid mass therein between a high heat section, a moderate heat section, and a low heat section. It is an object to maintain as nearly as possible a 55°–90° F heat range within the intermediate section, and to this end it is embraced between the high and low temperature sections for their cooperative effect in transferring heat thereto and therefrom.

Application of heat is coextensive of the three aforementioned heat range sections of the stratified thermal mass, it being an object to provide maximum thermal differential between the inlet and outlet of the solar heat collector. To this end, solar panels or the like are employed and from which the collected heat is applied to the high heat range section, and the heat progressively absorbed into the thermal mass as the liquid transfer media moves toward the low heat range section. With the stratification of high to low temperature within the mass, the thermal differential is increased between the outlet and inlet of the solar panel-collector.

Withdrawal of heat from the intermediate section of the thermal mass storage is by means of a closed loop pumping circuit through a mixing or proportioning valve and through a water to refrigerant heat exchanger, whereby the said water source to the heat exchanger is controlled within the 55°–90° F. water source range as by means of a thermostat control over said valve. In accordance with the invention provision is made for extraordinary conditions, one to apply heat as by the application of external energy and the other to remove heat as by the absorption of heat from the closed loop pumping circuit.

It is an object of this invention to provide an air conditioning system that is applicable to one or a plurality of temperature controlled zones, each conditioned by a water source heat pump associated with hot and cold thermal mass storage, the water source being assisted thereby to remain within the practical operational range of 55°–90° F on demand sensed by thermostat control applying and removing heat energy as required.

DRAWINGS

The various objects and features of this invention will be fully understood from the following detailed description of the typical preferred form and application thereof, throughout which description reference is made to the accompanying drawings, in which.

PREFERRED EMBODIMENT

Figure 1:
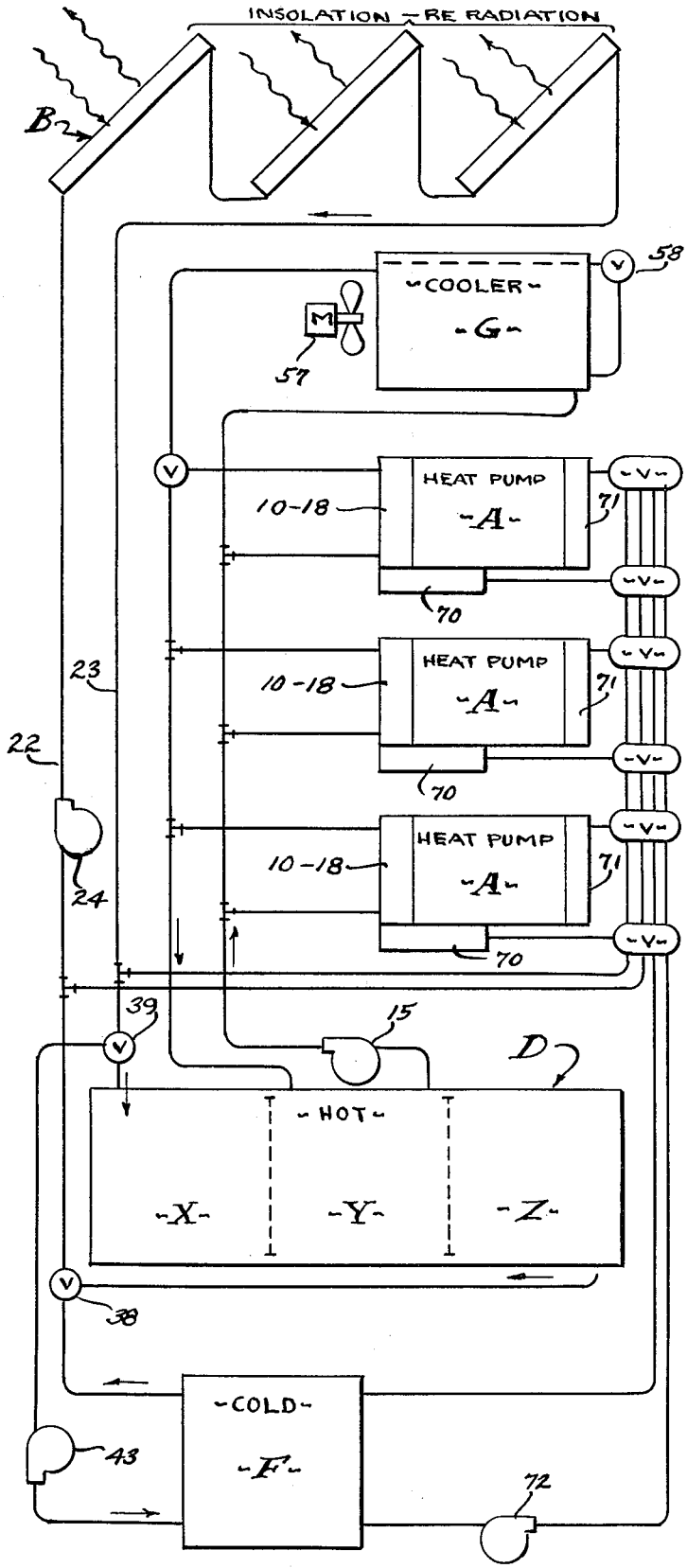
FIG. 1 is a block diagram of a multi unit heat pump system assisted through the stratified thermal mass which characterizes the present invention.

This invention relates to a hydronic heat pump and air conditioning system assisted by the environment in which it operates. Water source heat pumps A are employed that operate with a water source of determined heat range such as, for example, 55°–90° F, and it is this range within which the heat pumps of the present invention will be described to operate. Heat exchange means B is employed, preferably in the form of solar heat collectors, which may vary widely in form and construction, and which are primarily operative to collect heat energy into liquid or water up to 250° F, more or less; and differential control means C is provided to circulate solar heated water therethrough when it is at a higher temperature than the thermal mass to be increased in temperature thereby. A first stratified thermal mass D is provided in the form of a compartmented reservoir comprised of a high heat range section X associated with the heat exchange means B, a moderate heat section Y associated with the water source heat pump or pumps A, and a low heat range section Z associated with auxiliary needs such as to apply residual heat to pre-heating of domestic hot water. A second thermal mass E is provided in the form of a cold reservoir; and differential control means F is provided to circulate cooled water therethrough when it is at a lower temperature than the thermal mass to be decreased in temperature thereby. A heat absorption means G is provided for applying and/or removing heat from the heat pump water source circuit, and a residual heat transfer means H is provided for pre-heating the domestic hot water supply. In association with each of the aforementioned means A through H there are heat transfer coils and the like in the various liquid or water circuits that transfer heat directed for optimum operation of the system governed by thermostatic and differential controls, and all of which are associated with the stratified thermal mass D as will be described.

The heating pump A employed herein is of the water source type that requires a supply of 55°–90° F liquid, preferably water, to and from which heat is transferred by a refrigerant to source water heat exchanger coil 10 at the heat pump. The coil 10 is a closed loop water source circuit comprised of a delivery line 11 and a return line 12 extending from a heat exchanging coil 13 immersed in the moderate heat range section Y of the thermal mass D. The thermal mass temperature in section Y is, at most times, expected to be in excess of the maximum 90° F of the water source, and to this end a proportioning valve 14 is provided in delivery line 11 through which the source water is circulated by means of a pump 15, said valve being controlled by a temperature responsive means 16 in said line. The heat pump A is comprised, generally, of a housing 17 in which reversely operable heat exchanger coils 18 and 19 operate as evaporator and condensor elements of a mechanical refrigeration system which includes a compressor unit 20 with flow directive means and expansion valve means to condition the same for heating or cooling as may be required. That is, the flow directive means operates in the refrigeration mode by expanding refrigerant into the coil 19 as an evaporator in which case the coil 18 acts as a condensor. Conversely, in the heating mode the evaporation takes place in coil 18 while condensing takes place in coil 19.

In accordance with the operation of such heat pumps, the coil 10 and coil 18 are combined in the refrigerant-to-source water heat exchanger coil 10 that transfers heat at the heat pump unit in each mode of operation, in the former cooling mode to transfer heat into the water source loop return line 12, and in the latter heating mode to transfer heat into the refrigerant. A blower 21 circulates air through the coil 19 for heating and/or cooling the air conditioned zone serviced by the heat pump, it being understood that a plurality of heat pumps A draw water from the closed loop circuit, a series or parallel system, comprised of lines 11 and 12 (see FIG. 1). It is to be understood that the compressor unit 20 and the blower 21 are powered conventionally as by electric motors, or supplemented with or replaced by a Rankine cycle prime mover utilizing, for example, the solar collectors with super-heating and a turbine drive for achieving a solar powered cooling effect at the heat pump.

The heat exchange means B is shown primarily as a solar heat collecting panel that collects solar heat energy by insolation into a closed loop heat transfer circuit comprised of a delivery line 22 and a return line 23 extending from a heat exchanging coil 25 immersed coextensively throughout the high to low heat range sections X, Y, and Z. The means B is primarily for the absorption of solar heat by means of insolation, and they are secondarily for the dissipation of heat by means of terrestrial re-radiation as will later be described. The collector or collectors of means B are associated with the stratified thermal mass, the temperature in section X expected to be at a lower temperature than the collectors per se through which heat transfer liquid or water, preferably water-glycol solution, is circulated by a pump 24 through the lines 22 and 23, the pump being operated by a differential control means C with temperature responsive means 26 and 27 at the means B and thermal mass D respectively. The control means C is set so that the pump 24 is operated only when the collector temperature is greater than the thermal mass temperature within section X thereof.

Figure 3:
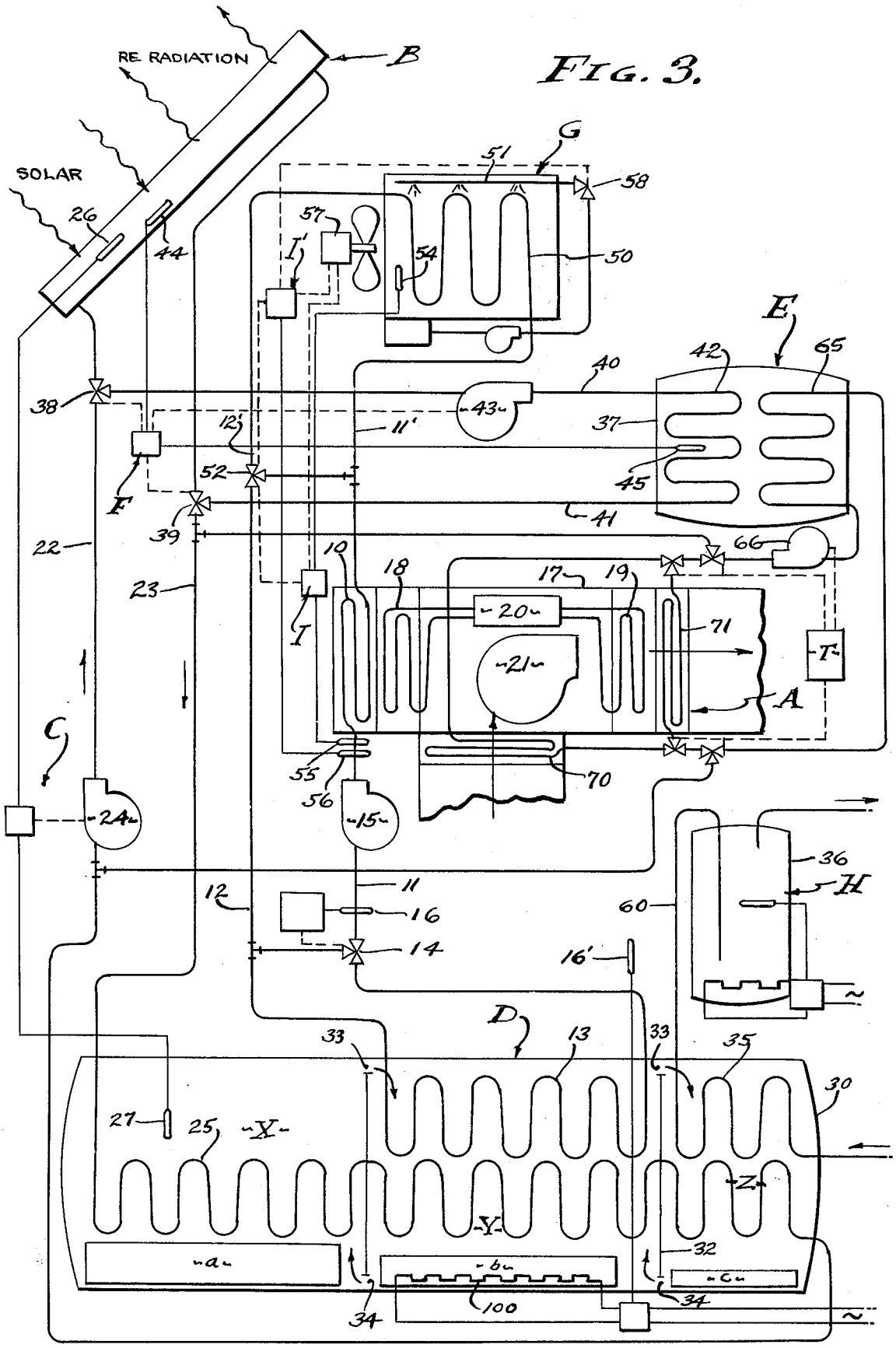
FIG. 3 is a detailed diagram of the system shown in FIG. 1.

The stratified thermal mass D is provided in accordance with the present invention to distribute heat throughout the several sections X, Y, and z and to separate higher temperature thermal mass from lower temperature thermal mass, according to the requirements of heat pump operation, the residual heat above ambient being used for auxiliary needs such as to preheat a hot domestic water storage heater. As shown, there are three sections in a liquid storage tank 30 having vertically disposed partitions 31 and 32 separating the tank into a high heat range section X, a moderate heat range section Y and a low heat range section Z. In FIGS. 1 and 3 the tank 30 is horizontally disposed and filled with a liquid mass such as water, in which case the partitions are provided with upper and lower liquid or water transfer ports 33 and 34 for the convection flow or thermal syphon effect of heated and/or cooling waters from one compartmented section to the other. Thus, cooler waters from section Y will enter into section X through lower ports 34 while hotter waters discharge from section X into section Y through the upper ports 33, and independently, cooler water from section Z will enter into section Y through lower ports 34 while hotter waters discharge from section Y into section Z through the upper ports 33. In carrying out the present invention, and in practice, a normal operational temperature range for section X is 70°–190° F, for section Y is 70°–120° F, and for section Z is 70°–100° F; however, it is to be understood that these temperature ranges will vary greatly dependent upon the availability of solar heat, and the use to which the system is put. Should there be insufficient heat captured by solar insolation and/or from ambient surroundings, an immersion electric heater 100, or any suitable available auxiliary heat source, is thermally conductive with the thermal mass (and mass *b* later described) so that if for any reason temperature sensed at sensor 16 (and with sensor 16' in outside air below a pre-determined setting) falls below 55° F at any time, heater 100 will be activated to maintain this temperature level.

Figure 2:
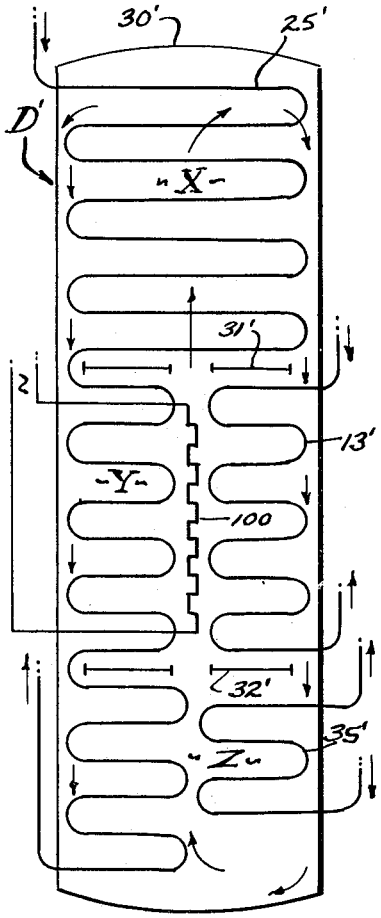
FIG. 2 shows a second form of stratified thermal mass.

Referring now to the disposition of the thermal mass D' as it is shown in FIG. 2, the three sections of the liquid storage tank 30' are defined by horizontally disposed partitions 31' and 32' separating the tank into an uppermost high heat range section X, an intermediate moderate heat range section Y and a lowermost low heat range section Z. The tank 30' is filled with a liquid mass such as a water-glycol solution, the partitions having central ports 33' for the convection rise of said water, and the partitions having marginal ports 34' for the convection descent of said water, in each instance from one compartmented section to the other. Thus, it will be seen that there is a heat differential between the top and bottom portion of the tank 30', there being a stratification of temperature zones established generally by the partitions placed substantially as shown. In practice, the heated water inlet is at the top of tank 30', heat being absorbed from coil 25' as it descends to the lowermost outlet where temperature is at a minimum. The coils 13' and 35' for extracting heat are as above described, each confined to its temperature zone or section.

Immersed in the low heat range section Z is a heat exchanging coil 35 comprising the residual heat transferring means H conducting domestic water from a public utility water supply or the like and to a domestic water storage heater 36. Alternately, the compartmented separation can be effected by a vertical disposition of the tank 30, with or without the partitions 31 and 32, and wherein the hottest liquid or water rises upwardly toward the top portion of the tank by means of the convection flow or thermal syphon effect. In accordance with the invention, the coextensive heating coil 25 is complementary to the aforesaid heat range stratification, having its hottest portion within section X, its moderate heat portion within section Y, and its low heat portion within section Z, all of which advantageously employs the maximum temperature differential available within the thermal mass D. It will be apparent, therefore, that there is a high heat range, a moderate heat range and a low heat range portion of the thermal mass that is stored in the tank 30, and each associated with heat transfer coils 25, 13, and 35, respectively, that induce the foresaid heat range differentiations by their induction, conduction and dissipation of heat. As is indicated, supplementary mass *a*, *b*, and *c*, is installed residually in each of said sections X, Y, and Z respectively, and each communicatively capable of holding heat according to the section in which they remain, such as solid insoluble material of selectively high heat retaining capabilities.

The second thermal mass E is provided in accordance with the present invention to separate a lower temperature thermal mass according to the dissipation availability with respect to terrestrial re-radiation and the like. In other words, the thermal mass E is a cold reservoir from which heat energy is removed. Accordingly, the mass E advantageously utilizes the aforesaid heat exchange means B which is secondarily a dissipator of heat by means of terrestrial re-radiation, since the outside environment is at night times often lower than the thermal mass temperature in the reservoir of means E. To these ends, the means E involves a liquid storage tank 37 filled with a liquid mass such as water, preferably the same water-glycol solution that is circulated through the collector B, to be stored at low temperatures below 70° F. The thermal mass E is associated with the stratified thermal mass D through the aforementioned delivery and return lines 22 and 23 that are tapped by diverting valves 38 and 39 which alternately direct the collector flow through delivery and return lines 40 and 41 and through heat exchanging coils 42 within the tank 37. The pump 43 is operable to circulate the low temperature water when required as controlled by a differential control means F with temperature responsive means 44 and 45 at the collector and thermal mass E respectively. The control means F is set so that the pump 43 is operated thereby only when the collector temperature is lesser than the thermal mass temperature within the tank 37 up to some pre-determined minimum temperature to be maintained at all times in tank 37. A heat exchanging coil 65 is immersed in the tank 37 of thermal mass E, and through which liquid heat transfer media is circulated by a pump 66 on demand of any one of the water source heat pump units and responsive to the thermostat T controlling the same in each instance.

The heat absorption means G is a heat exchanging device comprised principally of heat exchanging coils 50, installed out of doors, and operable either to dissipate or to absorb heat. To this end the coils 50 suffice for operation of means G in a "heat mode", and evaporation means 51 is combined with said coils for operation of said means G in a "cool mode". It is significant that the heat absorption means G is associated with the stratified thermal mass D through the aforementioned delivery and return lines 11 and 12 that are tapped by a diverting valve 52 which alternately directs the flow of lines 11 and 12 through the coil 50. The pump 15 is operable to circulate the water as required. The heat mode is put into effect, by turning on a fan 57, for example, when the water sources temperature is near or below the minimum 55° F and the outside air is of higher temperature, by a differential control means I with temperature responsive means 54 and 55 at the outside air and in the water source loop respectively. The cool mode is put into effect by opening a valve 58, for example, when the water source temperature is near or above the maximum 90° F, by a control means I′ with temperature responsive means 56 in the water source loop. Operation of either the heat or cool mode actuates the valve 52 to extend the water source loop through lines 11′ and 12′ and through the coil 50, and simultaneously to energize the motor 57 of an air circulating fan. During operation of the cool mode actuation of a water valve 58 may be required to apply moisture over the coil 50 and achieve additional capacity by means of evaporative cooling. The evaporative cooling and heat absorption means G is, therefore, a two-way or dual purpose means that tempers the closed loop water source by extending the same for heating or cooling as circumstances require.

The heat pump A is assisted in each instance in both the heating mode and the cooling mode, as determined by a multi range thermostat T. The thermostat T is temperature responsive within a zone to be air conditioned and controls assistance from either the heat exchange means B or the cold thermal mass E, by directing hot and cold fluid selectively through heat exchanging coils 70 and 71 at the return inlet and useful air outlet, respectively, of the water source heat pump A. Valves 72 and 72′ controlled by thermostat T determine flow through heat exchanging coils 70 or 71, while valves 73 and 73′ controlled by the thermostat T determine flow from the heat exchange means B or the thermal mass E. In the heating mode, the valve 72 and 72′ are open only through the heat exchanging coil 70 and through the valves 73 and 73′ directly assisted through the heat exchanging means B acting as a solar heat collector, via the lines 22 and 23; and only in the event that the said assistance is insufficient, the water source heat pump A is operated in the heat mode. In the cooling mode, the valves 72 and 72′ are open only through the heat exchanging coil 71 and through the valve 73 and 73′ directly assisted through the cold thermal mass E acting as a direct cold source; and the water source heat pump A operated in the cooling mode. In the event that the effect of load transfer on supply air delivered through coil 71 will not permit the pre-determined zone space temperature to be maintained with water source heat pump A operative, then said flow to coil 71 is shut off so that all of the available capacity of the water source heat pump A can be utilized for cooling of its respective zone. However, if the latter unassisted operation of the heat pump A remains insufficient, only then does the thermostat T operates the valve 72 to open and direct flow to heat exchanging coil 70 for lowering the temperature at the inlet of return air, at the point of greatest thermal differential. Thus, the water source heat pump A is automatically assisted by direct hot or cold sources, as circumstances require.

The residual heat temperature means H is associated with the stratified thermal mass D to absorb heat from the low heat range section Z thereof. It is the domestic water storage heater 36, or a like utility such as a pool heater, that is in a line 60 through coil 35, by which means water is pre-heated to a temperature not to exceed the 140° F or thereabouts available in the section Z.

From the foregoing it will be seen that the stratified thermal mass D is associated in a combination that interrelates the collection of solar heat and re-radiated heat, the isolates a closed loop water source for use with a number of heat pumps, and that utilizes residual heat. The means hereinbove described cooperate for most efficient operation of the heat pump or pumps assisted through environmental conditions by means of stratifying the primary thermal mass in which heated liquid is stored throughout the high to low heat range sections and from which a water source draws heat from a moderate heat section for assisting the heat pump operation. It is significant that the coextensive application of heat throughout the high to low heat range sections of the thermal mass D, taken together with withdrawal of heat from one or more of said sections, maximizes the temperature differential between the intake and outlet of the solar heat collector of means B for their most efficient operation, and pumping requirements are thereby decreased. The secondary thermal mass stores cold liquid utilized for assisting the said water source heat pump operation by heat transfer and cooling of circulated return and useful supply air. With the circulation system as it is herein disclosed, the size of individual heat pumps per se, which are usually established by space cooling requirements, can be minimized in capacity as compared with heat pumps required in unassisted systems, and peak load sustained with the assistance through the stratified thermal mass from the re-distributed heat and cold sources as described.

Having described only the typical preferred form and application of my invention, I do not wish to be limited or restricted to the specific details herein set forth, but wish to reserve to myself any modifications or variations that may appear to those skilled in the art.

I claim:

1. A solar insolation assisted air conditioning system wherein at least one water source mechanical refrigeration heat pump is operable to condition and to discharge return air from and into a zone to be air conditioned, and including; heat exchange means for the collection of solar heat into a first liquid heat transfer media, a stratified thermal mass having high heat range to low heat range sections, there being a heat transfer and pump means directing the said first liquid heat transfer media from the heat exchange means into the high heat range section of said stratified thermal mass and therethrough returning the said first liquid heat transfer media to the heat exchange means from the low heat range section of said stratified thermal mass, and there being a water source heat transfer means directing a second liquid heat transfer media through an intermediate moderate heat range section of said stratified thermal mass and through a heat energy exchanging coil of the said water source mechanical refrigeration heat pump.

2. The solar insolation assisted air conditioning system as set forth in claim 1, wherein the stratified thermal mass is comprised of a liquid storage tank.

3. The solar insolation assisted air conditioning system as set forth in claim 1, wherein the stratified thermal mass is comprised of a liquid storage tank having thermal partitions defining the heat range sections thereof.

4. The solar insolation assisted air conditioning system as set forth in claim 1, wherein the stratified thermal mass is comprised of a liquid storage tank having internal partitions defining the heat range sections thereof and with ports therethrough for flow of said liquid from section to section.

5. The solar insolation assisted air conditioning system as set forth in claim 1, wherein the stratified thermal mass is comprised of a horizontally disposed and elongated liquid storage tank having internal partitions defining the heat range sections thereof and with high and low ports therethrough for convection flow of said liquid from section to section.

6. The solar insolation assisted air conditioning system as set forth in claim 1, wherein the startified thermal mass is comprised of a vertically disposed and elongated liquid storage tank having internal partitions defining the heat range sections thereof and with ports therethrough for convection flow of said liquid from section to section.

7. The solar insolation assisted air conditioning system as set forth in claim 1, wherein the stratified thermal mass is comprised of a vertically disposed and elongated liquid storage tank having internal partitions defining the heat range sections thereof and with central ports therethrough for convection upward flow and and perimeter ports therethrough for downward convection flow of said liquid from section to section.

8. The solar insolation assisted air conditioning system as set forth in claim 1, wherein the stratified thermal mass has high, moderate and low heat range sections, there being an auxiliary heat transfer means directing a third liquid through the low heat range section for the absorption of residual heat.

9. The solar insolation assisted air conditioning system as set forth in claim 1, wherein the stratified thermal mass is comprised of a liquid storage tank with heater means exposed to the stored liquid within the said intermediate moderate heat range section.

10. The solar insolation assisted air conditioning system as set forth in claim 1, wherein the stratified thermal mass has high, moderate and low range sections, with an immersion heater means exposed to the stored liquid within the said intermediate moderate heat range section, there being an auxiliary heat transfer means directing a third liquid through the low heat range section for the absorption of residual heat.

11. A solar insolation and re-radiation assisted air conditioning system wherein at least one water source mechanical refrigeration heat pump is operable to condition and to discharge return air from and into a zone to be air conditioned, and including; heat exchange means for the collection of solar heat into a first liquid heat transfer media, a primary stratified thermal mass having high heat range to low heat range sections, a secondary thermal mass, there being a hot fluid transfer and pump means directing the first liquid heat transfer media from the heat exchange means into the high heat range section of said primary stratified thermal mass and therethrough retaining the said first liquid heat transfer media to the heat exchange means from the low heat range section of said stratified thermal mass, differential control means restricting operation of the hot fluid transfer and pump means within a determined heat range of said first liquid heat transfer media, there being a cold fluid transfer and pump means directing the first liquid heat transfer media from the heat exchange means into said secondary thermal mass and therethrough returning the said first liquid heat transfer media to the heat exchange means, differential control means restricting operation of the cold fluid transfer and pump means within a determined cold range of said first liquid heat transfer media, there being a water source heat transfer and pump means directing a second liquid heat transfer media through an intermediate moderate heat range section of said primary stratified thermal mass and through a heat energy exchanging coil of the said water source mechanical refrigeration heat pump, there being a cooled fluid transfer and pump means directing a third liquid heat transfer media through said secondary thermal mass and through heat energy exchanging coils in the air flow through the said heat pump, and control means restricting operation of the last mentioned cooled fluid transfer and pump means to circulate said liquid on demand.

12. The solar insolation and re-radiation assisted air conditioning system as set forth in claim 11, wherein the primary stratified thermal mass and secondary mass are comprised of liquid storage tanks.

13. The solar insolation and re-radiation assisted air conditioning system as set forth in claim 11, wherein the last mentioned control means comprises thermostat means operable in a heating mode to direct the first liquid heat transfer media by valve means via said hot fluid transfer and pump means through said energy exchanging coil in the return air inlet to the water source heat pump.

14. The solar insolation and re-radiation assisted air conditioning system as set forth in claim 11, wherein the last mentioned control means comprises thermostat means operable in a heating mode simultaneously to operate the water source heat pump in its heating mode and to direct the first liquid heat transfer media by valve means via said hot fluid transfer and pump means through said energy exchanging coil in the return air inlet to the water source heat pump.

15. The solar insolation and re-radiation assisted air conditioning system as set forth in claim 11, wherein the last mentioned control means comprises thermostat means operable in a cooling mode simultaneously to operate the water source heat pump in its cooling mode and to direct the third liquid heat transfer media by valve means via said cooled fluid transfer and pump means through said energy exchanging coil in the return air discharge from the water source heat pump.

16. The solar insolation and re-radiation assisted air conditioning system as set forth in claim 11, wherein the last mentioned control means comprises thermostat means operable in a cooling mode simultaneously to operate the water source heat pump in its cooling mode and to direct the third liquid heat transfer media by valve means via said cooled fluid transfer and pump means through said energy exchanging coil in the return air inlet from the water source heat pump.

17. A solar insolation assisted air conditioning system wherein at least one water source mechanical refrigeration heat pump is operable to condition and to discharge return air from and into a zone to be air conditioned, and including; heat exchange means for the collection of solar heat into a first liquid heat transfer media, a stratified thermal mass having high heat range to low heat range sections, there being a heat transfer and pump means directing the said first liquid heat transfer media from the heat exchange means into the high heat range section of said stratified thermal mass and therethrough returning the said first liquid heat transfer media to the heat exchange means from the low heat range section of said stratified thermal mass, there being a water source heat transfer and pump means directing a second liquid heat transfer media through an intermediate moderate heat range section of said stratified thermal mass and through a heat energy exchanging coil of the said water source mechanical refrigeration heat pump, there being a heat exchanging means for applying heat to and removing heat from the second liquid heat transfer media, and means for extending circulation of the second liquid heat transfer media through said last mentioned heat exchanging means.

18. The insolation assisted air conditioning system as set forth in claim 17, wherein the last mentioned heat exchanging means is an absorption means operable to heat said second liquid heat transfer media.

19. The insolation assisted air conditioning system as set forth in claim 17, wherein the last mentioned heat exchanging means is an evaporation means operable to cool said second liquid heat transfer media.

20. The insolation assisted air conditioning system as set forth in claim 17, wherein the last mentioned heat exchanging means is a combined absorption and evaporation means operable alternately to heat said second liquid heat transfer media and to cool said second liquid heat transfer media.

21. The insolation assisted air conditioning system as set forth in claim 17, wherein the last mentioned heat exchanging means is an absorption means operable to heat said second liquid heat transfer media, there being control means responsive to insufficient heat in said second liquid heat transfer media to operate said control means therefor for extending circulation thereof through said heat exchanging means for the transfer of heat into said second liquid heat transfer media.

22. The insolation assisted air conditioning system as set forth in claim 17, wherein the last mentioned heat exchanging means is an evaporation means operable to cool said second liquid heat transfer media, there being control means responsive to exessive heat in said second liquid heat transfer media to operate said control means for extending circulation thereof through said heat exchanging means for the transfer of heat from said second liquid heat transfer media.

23. The insolation assisted air conditioning system as set forth in claim 17, wherein the last mentioned heat exchanging means is a combined absorption and evaporation means operable alternately to heat and to cool said second liquid heat transfer media, there being control means responsive to both insufficient and excessive heat in said second liquid heat transfer media to operate said control means therefor for extending circulation thereof through said heat exchanging means for the alternate transfer of heat into and from said second liquid heat transfer media.

* * * * *